US006038794A

United States Patent [19]

Kilander

[11] Patent Number: 6,038,794

[45] Date of Patent: Mar. 21, 2000

[54] COMBINED BROOM AND RAKE

[76] Inventor: Holger Kilander, HC 75, Box 152, Hackensack, Minn. 56542

[21] Appl. No.: 09/033,182

[22] Filed: Mar. 2, 1998

[51] Int. Cl.[7] ..... E01H 5/02; A47L 13/02

[52] U.S. Cl. ..... 37/285; 15/111; 15/114; 15/236.08

[58] Field of Search ..... 37/219, 266, 285; 56/400.05, 400.03, 400.04; 15/111, 114, 236.08, 236.01

[56] References Cited

U.S. PATENT DOCUMENTS

| | | | |
|---|---|---|---|
| D. 63,074 | 10/1923 | Edlund | D4/135 |
| D. 227,199 | 6/1973 | Payne | D4/135 |
| D. 293,165 | 12/1987 | Machacek | D4/135 |
| D. 302,059 | 7/1989 | Sanders . | |
| D. 355,075 | 2/1995 | Stone . | |
| D. 391,714 | 3/1998 | Kilander . | |
| 565,042 | 8/1896 | Slocum | 15/111 |
| 1,142,698 | 6/1915 | Grove et al. | 15/111 |
| 1,209,927 | 12/1916 | Bailey . | |
| 1,314,967 | 9/1919 | McKee | 15/111 |
| 1,582,250 | 4/1926 | Cuthbert . | |
| 1,922,998 | 8/1933 | Williams | 15/111 |
| 1,956,263 | 4/1934 | Anderson . | |
| 2,475,862 | 7/1949 | Tomkins . | |
| 2,735,129 | 2/1956 | Lorenz . | |
| 3,111,699 | 11/1963 | Comeau . | |
| 3,131,419 | 5/1964 | Vosbikian et al. . | |
| 3,134,124 | 5/1964 | Horn . | |
| 3,324,494 | 6/1967 | Vosbikian | 15/114 |
| 3,332,223 | 7/1967 | Polisso . | |
| 4,528,713 | 7/1985 | Libman | 15/146 |
| 4,597,204 | 7/1986 | Heiden | 37/285 |
| 4,741,149 | 5/1988 | Vom Braucke et al. | 15/111 X |
| 4,756,039 | 7/1988 | Pardo | 15/160 |
| 4,856,136 | 8/1989 | Janssen | 15/244.3 |
| 5,309,654 | 5/1994 | Mathis . | |
| 5,343,684 | 9/1994 | Siler, III . | |
| 5,502,857 | 4/1996 | Jubinville | 15/111 |

FOREIGN PATENT DOCUMENTS

| | | | |
|---|---|---|---|
| 610237 | 12/1936 | Germany | 15/236.08 |

*Primary Examiner*—H. Shackelford
*Attorney, Agent, or Firm*—L. MeRoy Lillehaugen; Alan Kamrath

[57] ABSTRACT

A snow broom (10) includes a scraper element (12) and multiple sweeping elements (26, 36) positioned on opposite sides thereof. The scraper element (12) is in the preferred form of a sheet of relatively stiff plastic and includes serrations (22) formed on its lower edge (16). The lower edge (16) of the scraper element (12) is divided into a plurality of tines by cuts (24) extending from the lower edge (16). The inner sweeping elements (26) positioned adjacent to and on opposite sides of the scraper element (12) are formed from a sheet of foamed plastic of a flexibility to conform to the surface being swept and having a lower edge (30) parallel to and spaced slightly above the lower edge (16) of the scraper element (12). The outer sweeping elements (36) are formed from a sheet of extruded plastic to which snow does not have an affinity to stick. In addition to providing a sweeping function, the outer sweeping elements (36) provide protection and stiffening for the inner sweeping elements (26). The scraper and sweeping elements (12, 26, 36) are attached together in a stacked arrangement and are secured to a handle (46) by a shroud (54), with the handle (46) extending at a nonperpendicular angle to the lower edges (16, 30, 40) of the scraper and sweeping elements (12, 26, 36).

20 Claims, 2 Drawing Sheets

COMBINED BROOM AND RAKE

BACKGROUND

The present invention generally relates to brooms for sweeping debris from surfaces, particularly to devices for removing snow and similar debris from surfaces, and specifically to a combined broom and rake.

A common method of removing snow from sidewalks, steps, decks and like surfaces is by shoveling the snow from the surface. However, shoveling requires considerable manual lifting and throwing of the snow as well as involving the user bending. Although various shovels have been designed which tend to reduce or minimize bending and the manual labor required of the user, there is a desire for new ways to remove snow which increase the comfort of the user and reduce the effort of the user. Additionally, on wooden as well as other surfaces, care must be taken to prevent the shovel from scratching or otherwise marring the surface when removing snow therefrom.

A common method for removing dirt and similar debris from sidewalks, steps, decks and like surfaces is by sweeping the dirt therefrom using a broom. A preferred type of broom for elongated surfaces is one which is moved generally in an arc from side to side while the user walks in the elongated direction. The user is able to walk in a generally erect condition and minimal lifting of the broom and debris is required. While effective for removing dirt and the like from such surfaces, brooms are generally not very effective in removing snow and similar debris from such surfaces for several reasons. Specifically, snow tends to develop a crust and otherwise becomes compacted on the surface such as the result of being walked upon before the snow is removed. Bristles of conventional brooms are often of insufficient strength to enter into and/or break snow located on the surface. Additionally, due to the relatively large volume and mass of the snow, the free ends of the bristles of conventional brooms often will simply bend backwards in an arcuate manner and simply ride over the snow rather than pushing the snow from the surface.

Thus, there continues to be a need for improved methods for removing snow from surfaces which increase the comfort of the user and which reduce the effort required of the user.

SUMMARY

The present invention solves this need and other problems in the field of snow and similar debris removal by providing, in the preferred form, a relatively flexible sweeping element which abuts with and is supported by a planar, relatively stiff, scraper element having a lower edge which engages the surface, with the sweeping element pushing and removing the snow from the surface.

In preferred aspects of the present invention, multiple sweeping elements are provided, with the outer sweeping elements being formed of linear plastic to which snow does not have an affinity to stick and which protect and sandwich inner sweeping elements of greater flexibility to conform to the surface. In most preferred forms, the inner sweeping elements are formed of a sheet of foamed plastic. Additionally, in the most preferred form, the sweeping elements are positioned on both faces of the scraper element to allow snow removal when moved in opposite directions. In most preferred forms, the lower edges of the scraper and sweeping elements are at a nonperpendicular angle to an elongated handle secured to the scraper and sweeping elements.

In other preferred aspects of the present invention, the scraper element is formed by a sheet including serrations on the lower edge and divided into a plurality of tines by cuts extending from the lower edge.

It is thus an object of the present invention to provide a novel device for removing snow and similar debris from a surface.

It is further an object of the present invention to provide such a novel snow removal device which does not require the user to bend.

It is further an object of the present invention to provide such a novel snow removal device which does not require the user to lift.

It is further an object of the present invention to provide such a novel snow removal device which can be formed of plastic.

It is further an object of the present invention to provide such a novel snow removal device to which snow does not have an affinity to stick.

It is further an object of the present invention to provide such a novel snow removal device which will not scratch or otherwise mar the surface from which snow and similar debris is being removed.

It is further an object of the present invention to provide such a novel snow removal device which provides enhanced cleaning of the surface of snow and similar debris.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 2:
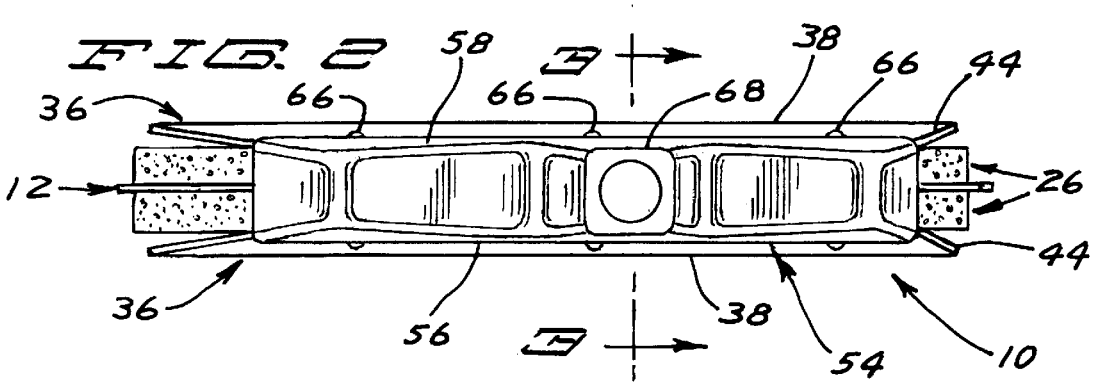
FIG. 2 shows a top plan view of the combined broom and rake of FIG. 1.
Figure 4:
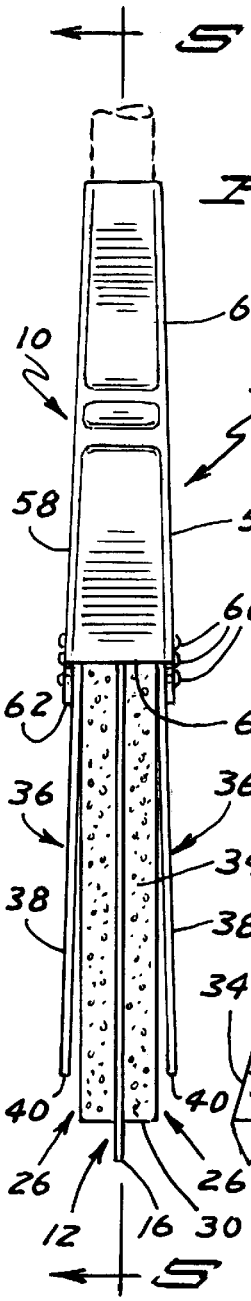
FIG. 4 shows an end elevational view of the combined broom and rake of FIG. 1.
Figure 1:
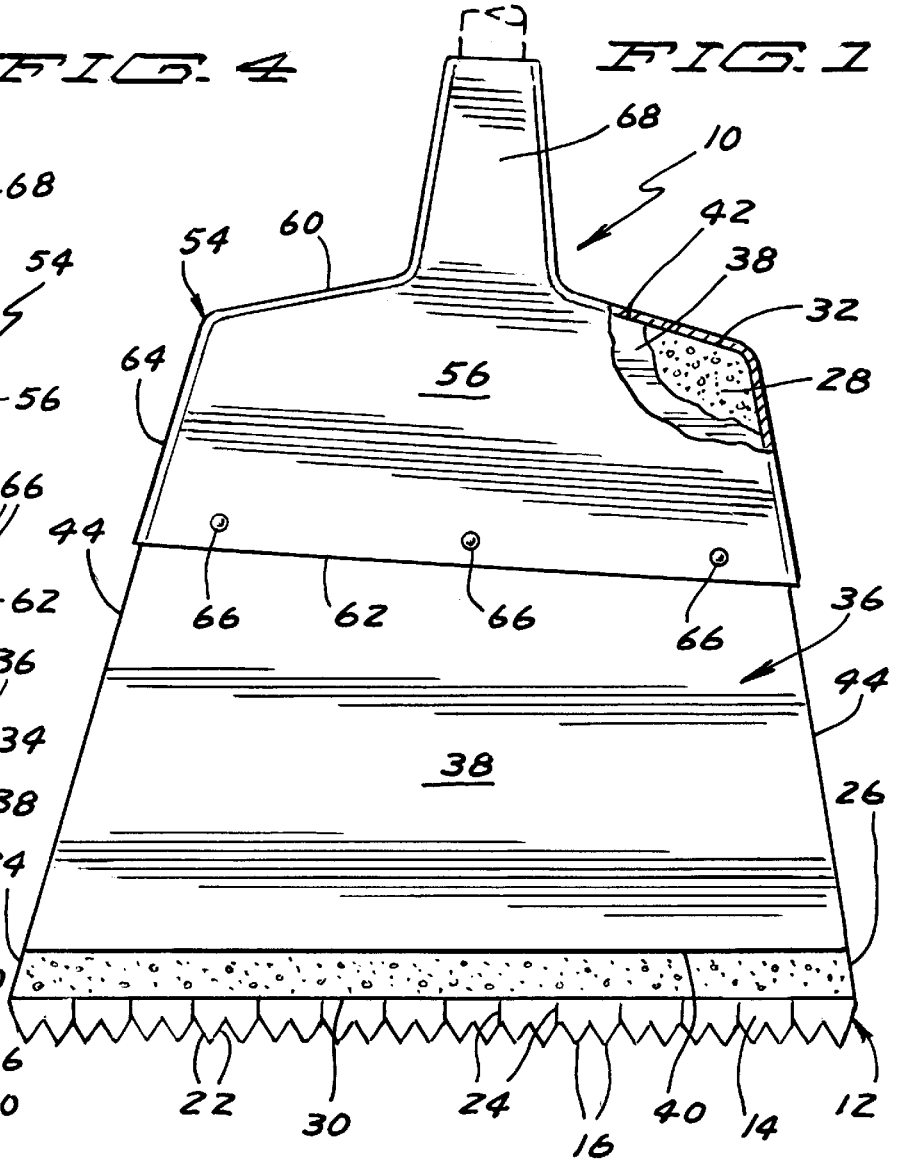
FIG. 1 shows a side elevational view of a combined broom and rake according to the preferred teachings of the present invention, with portions broken away to show constructional details.
Figure 3:
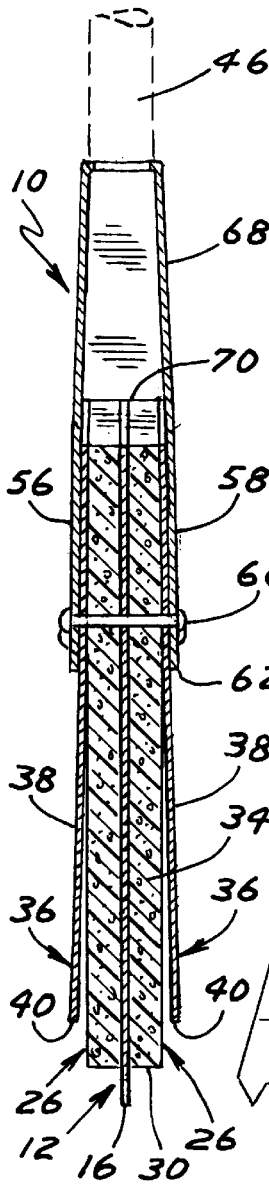
FIG. 3 shows a cross sectional view of the combined broom and rake of FIG. 1 according to section line 3—3 of FIG. 2.
Figure 5:
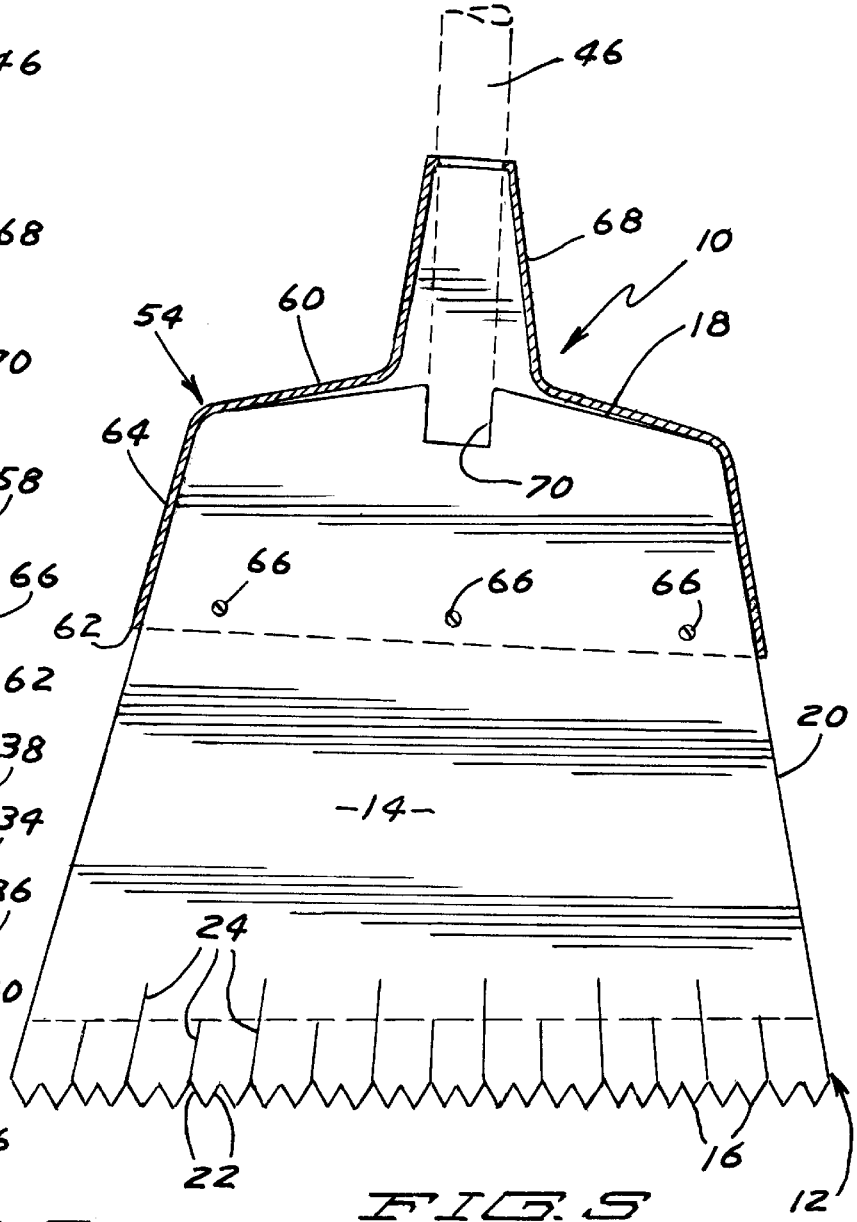
FIG. 5 shows a cross sectional view of the combined broom and rake of FIG. 1 according to section line 5—5 of FIG. 4.

All figures are drawn for ease of explanation of the basic teachings of the present invention only; the extensions of the figures with respect to number, position, relationship, and dimensions of the parts to form the preferred embodiment will be explained or will be within the skill of the art after the following description has been read and understood. Further, the exact dimensions and dimensional proportions to conform to specific force, weight, strength, and similar requirements will likewise be within the skill of the art after the following description has been read and understood.

Where used in the various figures of the drawings, the same numerals designate the same or similar parts. Furthermore, when the terms "first", "second", "front", "back", "outer", "inner", "upper", "lower", "height", "width", "length", "thickness", "end", "side", "horizontal", "vertical", and similar terms are used herein, it should be understood that these terms have reference only to the structure shown in the drawings as it would appear to a person viewing the drawings and are utilized only to facilitate describing the illustrative embodiment.

DESCRIPTION

A combined broom and rake for sweeping snow from steps, decks, sidewalks and like surfaces according to the preferred teachings of the present invention is shown in the drawings and generally designated 10. In the most preferred form, broom 10 is of the type shown and described in U.S. Pat. application Ser. No. 29/067,264 filed Feb. 18, 1997, now U.S. Pat. No. Des. 391,714 issued on Mar. 3, 1998, which is hereby incorporated herein by reference. Snow broom 10 generally includes a planar, relatively stiff, scraper element 12. In the most preferred form, scraper element 12 is formed of a sheet of extruded, linear plastic. Scraper element 12 generally includes first and second faces 14, a lower edge 16, an upper edge 18, and first and second side edges 20. Lower edge 16 includes suitable provisions for providing a scraping action when engaged with a surface. In the most preferred form, lower edge 16 includes serrations 22 defined by a plurality of generally V-shaped notches extending from lower edge 16. In the most preferred form, lower edge 16 of scraper element 12 is divided into a plurality of tines by cuts 24 extending from alternate serrations 18 towards but spaced from upper edge 18. In the most preferred form, alternate cuts 24 extend a distance generally equal to one half of the distance of the remaining cuts 24. It can be appreciated that cuts 24 define tines which are allowed to flex relative to each other and the remaining portions of scraper element 12. In the preferred form shown, the longer cuts 24 divide scraper element 12 into pairs of tines which can flex as a single element, and the shorter cuts 24 divide each of the pairs of tines into individual tines which can flex individually. This arrangement of the most preferred teachings of the present invention provides added strength to prevent breakage of individual tines from scraper element 12.

Snow broom 10 according to the most preferred teachings of the present invention generally includes first and second, planar, relatively flexible sweeping elements 26. In the most preferred form, sweeping elements 26 are formed of a cast, planar, foamed plastic material such as foamed polyethylene. Sweeping elements 26 each generally includes first and second faces 28, a lower edge 30, an upper edge 32, and first and second side edges 34. Sweeping elements 26 are of a size generally corresponding to scraper element 12. When the first faces 28 of first and second sweeping elements 26 abut with first and second faces 14 of scraper element 12, upper edges 18 and 32 and side edges 20 and 34 are aligned and contiguous but lower edges 30 of sweeping elements 26 are in a spaced, parallel relation from lower edge 16 of scraper element 12 in a direction towards upper edges 18 and 32 and in an amount greater than the distance that serrations 22 extend from edge 16 and less than the distance that cuts 24 extend from edge 16.

Snow broom 10 according to the most preferred teachings of the present invention generally includes first and second, planar, generally stiff, bulk sweeping, stiffening and protecting elements 36. In the most preferred form, each element 36 is formed of a sheet of extruded plastic such as linear polyethylene and having a flexibility greater than that of element 12 but substantially less than elements 26. Additionally, elements 36 are formed of material upon which snow or other debris desired to be removed easily slides and does not stick or otherwise adhere. Elements 36 each generally includes inner and outer faces 38, a lower edge 40, an upper edge 42, and first and second side edges 44. Elements 36 are of a size generally corresponding to sweeping elements 26. When inner faces 38 of elements 36 abut with the second faces 28 of first and second sweeping elements 26, upper edges 32 and 42 and side edges 34 and 44 are aligned and contiguous but lower edges 40 of elements 36 are in a spaced, parallel relation from lower edges 30 of sweeping elements 26 in a direction towards upper edges 32 and 42 and in an amount greater than the distance that serrations 22 extend from edge 16 and in the preferred form are spaced from edge 16 a distance generally equal to the extent of the shorter cuts 24.

Snow broom 10 according to the teachings of the present invention includes suitable provisions for attaching elements 12, 26, and 36 in a stacked arrangement to an elongated handle 46. In the preferred form shown, broom 10 includes a shroud 54 which can be molded as an integral unitary item from rigid polypropylene or similar plastic material. Shroud 54 generally includes a front 56, a back 58, a top 60, an open bottom 62 and first and second sides 64, with front 56 and back 58 being in a parallel relation at a spacing generally equal to the combined thickness of elements 12, 26, and 36. With elements 12, 26, and 36 extending through open bottom 62 between front 56 and back 58, upper edges 18, 32, and 42 can abut with top 60 and the upper portions of side edges 20, 34, and 44 can abut with sides 64. The lower edges of front 56 and back 58 defining open bottom 62 are in a spaced parallel relation from lower edges 16, 30 and 40 in a direction towards top 60 at a distance substantially greater than the distance of cuts 24 from lower edge 16. Suitable provisions for retaining elements 12, 26, and 36 in a stacked arrangement and in shroud 54 are provided such as a series of rivets 66 extending through front 56, first element 36, first element 26, element 12, second element 26, second element 36, and back 58 adjacent to and parallel to the lower edges of front 56 and back 58.

Shroud 54 further includes suitable provisions for securement to handle 46. In the preferred form, a collar portion 68 is formed by an extension of front 56, back 58, and top 60 intermediate sides 64 of a size for receipt of the lower end of handle 46. Additionally, upper edges 18, 32, and 42 of elements 12, 26, and 36 can include a notch 70 of a size for slideable receipt of the lower end of handle 46 when inserted into shroud 54. Collar portion 68 is suitably secured to handle 46 in a manner to prevent undesired removal such as by a friction fit, by glue, by a staple, or by a similar fastener extending through collar portion 68 and into handle 46. In the most preferred form, lower edges 16, 30, and 40 extend at a nonperpendicular angle to handle 46 in a similar manner as angle-cut brooms such that edges 16, 30, and 40 bear uniformly against the surface to be swept along the whole length of edges 16, 30, and 40 when broom 10 is in use. This not only enables all of edges 16, 30, and 40 to be evenly worn during use, but also facilitates sweeping corners and edges.

Now that the basic construction of broom 10 according to the preferred teachings of the present invention has been set forth, a method of use and some of the advantages of broom 10 can be explained and appreciated. Specifically, the user while standing generally vertically holds handle 46 adjacent to its upper end by a first hand close to the user's body and grasps handle 46 intermediate its ends by the other hand spaced from the user's body and in a manner such that edges 16, 30, and 40 are generally parallel to the surface desired to be cleaned. In a preferred method of use, the upper end of handle 46 is held by the first hand generally in a stationary manner while the second hand swings handle 46 along an arc having a center at the first hand and while edges 16, 30, and 40 are generally parallel to the surface desired to be cleaned.

In use and due to the arcuate movement of broom 10, first element 36 in the direction of movement can engage snow and other debris in the movement path and be forced against first element 26. Snow or other debris engaging first element 36 will be pushed or swept by element 36. It can then be appreciated that another of the major purposes of elements 36 is to protect element 26. Further, snow does not have a tendency to stick to element 36 but rather slides therefrom so that the snow does not have a tendency to stick and build up on broom 10 according to the teachings of the present material.

Similarly, first element 26 behind first element 36 is sandwiched between elements 12 and 36. Although element 26 is somewhat flexible, element 12 acts as a backing to generally prevent element 26 from flexing and specifically from bending into an arcuate shape adjacent to lower edge 30 especially as the result of the force of engagement of the snow with broom 10. Due to the flexibility of element 26, lower edge 30 of element 26 tends to conform to the surface being swept to remove snow and similar debris from the surface.

In addition to providing a backing support to element 26, element 12 also provides a scraping action against the surface being swept to break loose any hardened or otherwise adhered snow or similar debris from the surface. This scraping action is enhanced due to the provision of serrations 22 which engage the surface at points to concentrate the movement force thereon and thereby providing a scratching effect on the surface. In this regard, the formation of element 12 from extruded plastic as in the preferred form is advantageous in reducing the likelihood of scratching or otherwise marring the surface being swept. The scraping action produced by element 12 is also enhanced due to the provision of individual tines defined by cuts 24, with the individual tines allowing lower edge 16 to flex to conform to the surface being swept.

As the other, second element 26 is behind element 12 and not supported thereby, second element 26 will tend to separate from element 12 due to the flexibility of element 26. It can then be appreciated that another of the major purposes of element 36 is to reduce the separation of the other element 26 behind element 12 from element 12, with element 36 behind element 12 due to its flexibility also tending to separate from element 12 but in an amount considerably less than element 26 would if not supported by element 36.

When moved in an arcuate motion and after broom 10 has been moved to the top of the arc in one direction, broom 10 is moved in the opposite direction. Then, second elements 26 and 36 on the opposite side of broom 10 would engage the snow and similar debris on the surface being swept and operates in like manner as when broom 10 was moving in the opposite direction. Thus, the surface can be cleaned of snow and similar debris in a sweeping motion, with the snow being pushed to the opposite sides of the surface and generally perpendicular to the walking direction of the user.

Now that the construction and a method of use of broom 10 of the most preferred form of the present invention have been set forth, many extensions and variations will be obvious to one having ordinary skill in the art. For example, although scraper element 12 in the most preferred form is formed from a single sheet of plastic, scraper element 12 can take other forms according to the teachings of the present invention. Specifically, scraper element 12 could be formed from two or more layers. In this regard, broom 10 could be formed like pages of a book, with scraper element 12 formed from a single sheet folded in the center, with first and second sweeping elements 26 also formed of a single sheet folded in the center and overlying the two layer scraper element 12, and with first and second elements 36 also formed of a single sheet folded in the center and overlying first and second sweeping elements 26 opposite to scraper element 12. Handle 46 could be attached to the assembly such as by threading into a T-shaped holder having its head extending along the fold of the sheet forming the scraper element 12. Elements 12, 26, and 36 could be attached together by rivets or similar fasteners extending therethrough and below the head of the T-shaped holder. Also, although in the most preferred form scraper element 12 is formed of plastic and is believed to be advantageous as being light weight, durable, strong, nonabsorbant, and scratch resistant, scraper element 12 could be formed of other material according to the teachings of the present invention such as metal such as spring steel and even white bakery board type paperboard. Similarly, although in the most preferred form scraper element 12 is formed from a sheet, scraper element 12 could have other forms according to the teachings of the present invention such as from a plurality of individual, straight tines which are interconnected only adjacent upper edge 18. Such individual tines would provide greater flexibility while collectively providing the necessary support.

Likewise, although sweeping elements 26 in the most preferred form are formed from sheets of foamed plastic and are believed advantageous as generally preventing passage of debris therethrough while being lightweight and relatively durable for snow removal applications, sweeping elements 26 according to the teachings of the present application can take other forms including but not limited to bristles of natural or synthetic materials. It should be appreciated that especially when sweeping elements 26 are formed from bristles having sufficient strength to return to a normal condition after flexing, the need for elements 36 may be removed.

Similarly, although broom 10 in the most preferred form includes elements 26 of greater flexibility and elements 36 of lesser flexibility and is believed to be advantageous at least due to the enhanced ability to conform to the surface for removing snow and similar debris therefrom, elements 26 can be eliminated according to the teachings of the present invention with elements 36 providing the sole sweeping function.

Further, although broom 10 in the most preferred form is shown as being of the side-to-side movement type, broom 10 can take other forms according to the teachings of the present invention including but not limited to of the push type. Similarly, although handle 46 has been described to be of the elongated type for typically sweeping a surface upon which the user stands, broom 10 can be constructed for other applications according to the teachings of the present invention such as for removing snow and similar debris from an automobile or the like. Furthermore, although broom 10 of the most preferred form has special application for the removal of snow, broom 10 according to the teachings of the present application can be utilized for removal of other types of debris including but not limited to leaves and like bulky type items.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

I claim:

1. Device for removing snow and similar debris from a surface comprising, in combination: a scraper element having a lower edge for engaging the surface, with the scraping element being planar and relatively stiff; and at least a first sweeping element in a stacked arrangement with the scraper element and having a lower edge for engaging the surface, with the sweeping element being relatively flexible, with the sweeping element being pushed against, abutting with and being supported by the scraper element when pushing and removing the snow from the surface; wherein the first sweeping element is planar, with the lower edge of the first sweeping element being parallel to and spaced above the lower edge of the scraper element.

2. The snow removal device of claim 1 wherein the scraper element is formed by a plurality of tines which are allowed to flex relative to each other.

3. The snow removal device of claim 2 wherein the scraper element is formed by a sheet, with the lower edge of the scraper element being divided into the plurality of tines by cuts extending from the lower edge.

4. The snow removal device of claim 1 wherein the first sweeping element is formed of a sheet of foamed plastic.

5. The snow removal device of claim 4 further comprising, in combination: a second sweeping element, with the second sweeping element being planar and formed of a sheet of plastic having a flexibility less than the first sweeping element but greater than the scraper element, with the first sweeping element located intermediate the scraper element and the second sweeping element.

6. The snow removal device of claim 5 wherein the lower edge of the second sweeping element is parallel to and spaced above the lower edge of the first sweeping element.

7. The snow removal device of claim 5 further comprising, in combination: a third sweeping element, with the third sweeping element being planar, formed of a sheet of foamed plastic and located on the opposite side of the scraper element than the first sweeping element; and a fourth sweeping element, with the fourth sweeping element being planar and formed of sheet of plastic, with the third sweeping element located intermediate the scraper element and the fourth sweeping element.

8. The snow removal device of claim 7 further comprising, in combination: an elongated handle attached to the scraper and sweeping elements, with the handle extending at a nonperpendicular angle to the lower edges of the scraper and sweeping elements.

9. The snow removal device of claim 8 further comprising, in combination: a shroud for attaching the handle to the scraper and sweeping elements, with the shroud including a front and a back in a parallel relation from the front at a spacing generally equal to the thickness of the scraper and sweeping elements, with a fastener extending through the front and back of the shroud and the scraper and sweeping elements, with the shroud further including a collar portion for receipt of and securement to the handle.

10. The snow removal device of claim 1 wherein the scraper element is formed by a sheet, with the lower edge of the scraper element being divided into a plurality of tines by cuts extending from the lower edge; and wherein the lower edge of the scraper element includes serrations defined by a plurality of notches extending from the lower edge, with the cuts extending from the serrations.

11. The snow removal device of claim 1 wherein the sweeping element is planar and formed of a sheet of plastic to which snow does not have a tendency to stick.

12. The snow removal device of claim 1 further comprising, in combination: an elongated handle attached to the scraper and sweeping elements, with the handle extending at a nonperpendicular angle to the lower edges of the scraper and sweeping elements.

13. Device for removing snow and similar debris from a surface comprising, in combination: a scraper element having a lower edge for engaging the surface, with the scraping element being planar and relatively stiff; and at least a first sweeping element having a lower edge for engaging the surface, with the sweeping element being relatively flexible, with the sweeper element abutting with and being supported by the scraper element for pushing and removing the snow from the surface; wherein the scraper element is formed by a plurality of tines which are allowed to flex relative to each other; wherein the scraper element is formed by a sheet, with the lower edge of the scraper element being divided into the plurality of tines by cuts extending from the lower edge; and wherein the cuts extend at least first and second different distances, with the first distance being greater than the second distance, with the cuts of the first distance dividing the plurality of tines into groups of tines and with the cuts of the second distance dividing the groups of tines into individual tines.

14. The snow removal device of claim 13 wherein the lower edge of the scraper element includes serrations defined by a plurality of notches extending from the lower edge, with the cuts extending from the serrations.

15. The snow removal device of claim 13 wherein the first sweeping element is planar, with the lower edge of the first sweeping element being parallel to and spaced above the lower edge of the scraper element.

16. Device for removing snow and similar debris from a surface comprising, in combination: a scraper element having a lower edge for engaging the surface, with the scraping element being planar and relatively stiff; a first sweeping element having a lower edge for engaging the surface, with the sweeping element being relatively flexible, with the sweeping element abutting with and being supported by the scraper element for pushing and removing the snow from the surface; and a second sweeping element, with the second sweeping element being planar and formed of a sheet of plastic having a flexibility less than the first sweeping element but greater than the scraper element, with the first sweeping element located intermediate the scraper element and the second sweeping element.

17. The snow removal device of claim 16 further comprising, in combination: a third sweeping element, with the third sweeping element located on the opposite side of the scraper element than the first sweeping element; and a fourth sweeping element, with the fourth sweeping element being planar and formed of a sheet of plastic, with the third sweeping element located intermediate the scraper element and the fourth sweeping element.

18. The snow removal device of claim 17 further comprising, in combination: an elongated handle attached to the scraper and sweeping elements, with the handle extending at a nonperpendicular angle to the lower edges of the scraper and sweeping elements.

19. The snow removal device of claim 16 wherein the first sweeping element is formed of a sheet of foamed plastic.

20. The snow removal device of claim 19 wherein the first sweeping element is planar, with the lower edge of the first sweeping element being parallel to and spaced above the lower edge of the scraper element; and wherein the lower edge of the second sweeping element is parallel to and spaced above the lower edge of the first sweeping element.

* * * * *